US006609369B2

(12) United States Patent
Koehler et al.

(10) Patent No.: US 6,609,369 B2
(45) Date of Patent: Aug. 26, 2003

(54) SYSTEM AND METHOD OF PRESSURE COMPENSATION FOR ELECTRO HYDRAULIC CONTROL SYSTEMS

(75) Inventors: Douglas W. Koehler, Peoria, IL (US); Michael R. Schwab, Crest Hill, IL (US); Jiao Zhang, Naperville, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 09/997,095

(22) Filed: Nov. 28, 2001

(65) Prior Publication Data

US 2003/0097925 A1 May 29, 2003

(51) Int. Cl.[7] ..... F15B 9/03
(52) U.S. Cl. ..... 60/459; 91/363 R; 91/459
(58) Field of Search ..... 60/459; 91/361, 91/363 R, 369, 459

(56) References Cited

U.S. PATENT DOCUMENTS 3,410,177 A * 11/1968 Roess et al. ..... 91/361
4,586,332 A 5/1986 Schexnayder
4,643,074 A * 2/1987 Gunda et al. ..... 91/361
5,012,722 A * 5/1991 McCormick ..... 91/361
5,031,506 A * 7/1991 Baisch et al. ..... 91/363 R
5,056,561 A 10/1991 Byers
5,218,895 A 6/1993 Lukich et al.
5,305,681 A * 4/1994 Devier et al. ..... 91/361
5,560,387 A 10/1996 Devier et al.

* cited by examiner

*Primary Examiner*—Edward K. Look
*Assistant Examiner*—Igor Kershteyn
(74) *Attorney, Agent, or Firm*—Haverstock, Garrett & Roberts; Steve M Hanley

(57) ABSTRACT

A pressure compensator for use in a control system for an electro hydraulic-implemented work element being operated through the use of operator input control mechanisms generating operator input signals upon the application thereof, the control system including an actuator coupled thereto for controlling the operation thereof, the pressure compensator determining a pressure compensator coefficient to be applied to an operator input signal to compensate for changes of pressure drop across a valve in communication with the actuator. The pressure compensator coefficient is used to produce an input flow control signal for inputting to the valve to control the amount of hydraulic fluid that flows therethrough to the actuator so that a desired velocity of the actuator is achieved.

18 Claims, 4 Drawing Sheets

SYSTEM AND METHOD OF PRESSURE COMPENSATION FOR ELECTRO HYDRAULIC CONTROL SYSTEMS

TECHNICAL FIELD

This invention relates generally to an electro hydraulic control system and method and, more particularly, to a system and method of pressure compensation for electro hydraulic control systems.

BACKGROUND

Hydraulic systems are particularly useful in applications requiring a significant power transfer and are extremely reliable in harsh environments, for example, in construction and industrial work places. Earthmoving machines or "work machines", such as excavators, backhoe loaders, and front shovel loaders are a few examples where the large power output and reliability of hydraulic systems are desirable.

Typically, a diesel or internal combustion engine drives the hydraulic system. The hydraulic system, in turn, delivers power to operate the machine's work implement. The hydraulic system typically includes a pump for supplying pressurized hydraulic fluid and a directional valve for controlling the flow of hydraulic fluid to a hydraulically actuated device such as an actuator, cylinder, or motor which in turn delivers power to the work implement, i.e. a bucket. For example, a typical front shovel loader has three basic implement circuits including a boom, stick, and bucket appendages. Individual directional valves and hydraulic cylinders control each appendage. An operator may control the flow of hydraulic fluid, and therefore the velocity of each appendage, through one or more control handles which may be mechanical, electrical or electrohydraulic devices. The control handles provide devices for manual operation, in which the displacement of the control handle is indicative of the desired movement of the associated implement and therefore is also indicative of the flow of hydraulic fluid.

Fluctuations in pressure and flow of the hydraulic fluid supplied to the actuators are inherent characteristics of hydraulic systems. These fluctuations present several problems that the control system must accommodate. Supply pressure fluctuations have several causes. For example, hydraulic circuits are often connected in parallel and are driven by the same pump. Each hydraulic circuit, through its individual operations and load conditions, affects the hydraulic supply pressure. Also, a varying load on the work implement affects the actuator pressure and furthermore affects the amount of flow needed to produce the desired actuator velocity. For example, the work implement may be empty or may be filled and the load may vary while the work implement is moving.

In order to have consistent system response, it is desired to have a fixed flow of hydraulic fluid to move the actuator for a fixed velocity request. Supply pressure variations and varying loads affect the flow rate and therefore, cause the control system to produce undesirable behavior. In particular, it significantly decreases an operator's ability to accurately control the work implement. This lack of control also causes unnecessary wear and tear on the work implement itself, thereby reducing its effectiveness, further shortening its life span, and increasing the overall costs for maintaining the work machine.

U.S. Pat No. 4,586,332, issued to Schexnayder on May 6, 1986, discloses a two spool valve design for providing pressure compensation. As shown in FIG. 1, a directional control spool 24 has extend, retract and neutral positions for controlling the flow of hydraulic fluid to a hydraulic motor 20. A flow control spool 26 maintains a predetermined pressure differential across the directional control spool 24. Excess fluid from the pump is bypassed by the flow control spool to tank. This two spool valve design attempts to give a fixed flow rate for the extend and retract positions of the direction control spool 26 regardless of the load. However, the valve design is complex and adds cost to the system. Further, the two-spool valve design does not accommodate over-running cylinder loads.

Some control systems use a flow rate control valve to control the flow of hydraulic fluid to the cylinder and thus control its velocity. In the case of hydro-mechanical implementation, the flow rate valve is composed of a metering valve and a pressure compensator. The pressure compensator is used to insure the pressure drop across the metering valve near a constant, whereas the opening of the metering valve can be varied based upon the different flow rate. In the case of electrohydraulic implementation, pressure or pressure differential sensors are used to detect a pressure drop across a valve orifice and the orifice opening is determined by a controller, such as a microprocessor, based upon both pressure drop and desired flow rate. Pressure sensors and pressure differential sensors, however, are expensive. Moreover, they are subject to wear and tear, which significantly decreases their reliability over time, and as a result, they cannot provide a reliable long-term solution to the pressure fluctuations inherent in such hydraulic systems.

Accordingly, the present invention is directed to overcoming one or more of the problems as set forth above.

SUMMARY OF THE INVENTION

In one aspect of the present invention, a method for controlling pressure fluctuations in an electro hydraulic implemented-work element being operated through the use of operator input control mechanism generating operator input signals upon the application thereof, is disclosed. The work element includes an actuator device coupled thereto for controlling the operation thereof. The method comprises the steps of determining a desired and actual velocity of the actuator device, comparing the desired and actual velocity, generating a comparator output signal indicative of a difference between the compared desired and actual velocity, calculating a pressure compensator coefficient representing a ratio between the actual and desired velocity, modifying the comparator output signal by the pressure compensator coefficient to produce an input flow velocity control signal, and inputting the input flow velocity control signal to the valve.

BRIEF DESCRIPTION OF THE DRAWINGS

For a better understanding of the present invention, reference may be made to the accompanying drawings in which.

DETAILED DESCRIPTION

Figure 1:
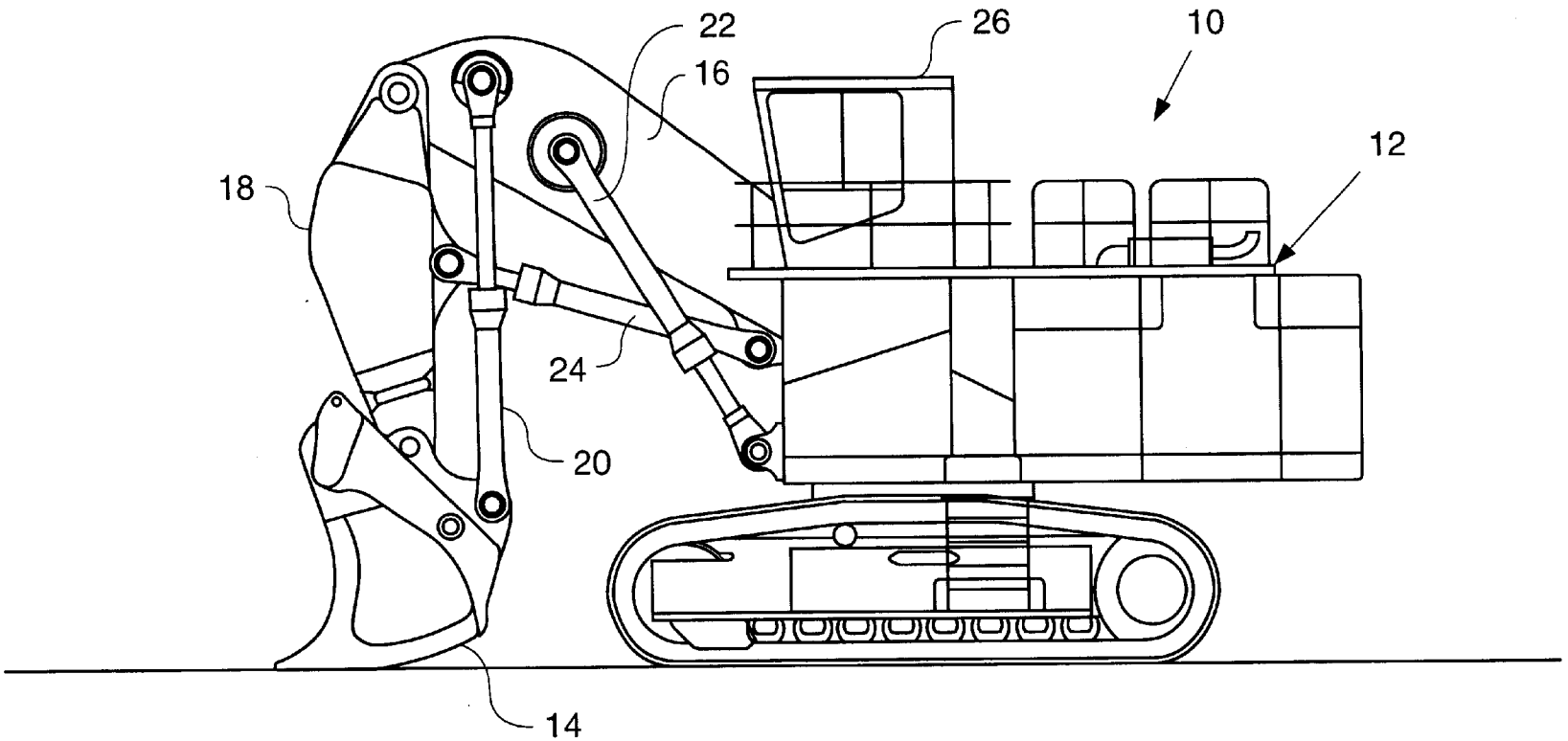
FIG. 1 is a perspective view of a front shovel work machine.
Figure 2:
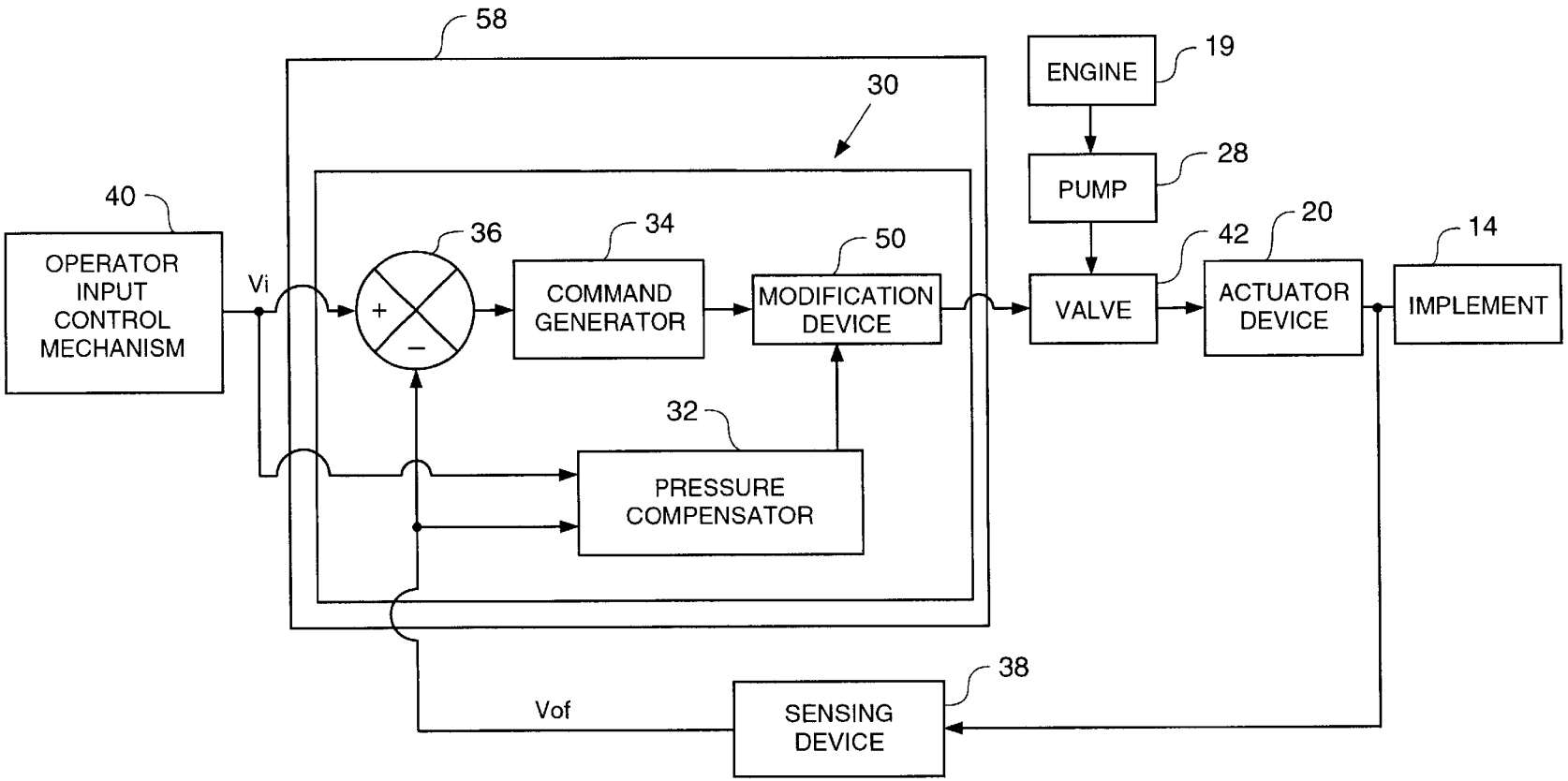
FIG. 2 is a block diagram of an electro hydraulic control system with pressure compensation according to the present invention.

Referring to FIG. 1, a typical work machine 10, such as a front shovel loader, is shown. Work machine 10 includes a mainframe or main body portion 12 which includes an operator cab 26 from which an operator not only controls movement of the work machine 10 but also controls the operation and movement of several work elements such as the implement or front shovel 14, the boom 16 and the stick 18, all of which are connected together as illustrated in FIG. 1 in a conventional manner. Implement 14, boom linkage mechanism 16 and stick linkage mechanism 18 are all controlled via electrohydraulic control valves connected respectively thereto through one or more hydraulic circuits (not shown) which control the operation of implement actuator device 20, boom actuator device 22, and stick actuator device 24. In this regard, one or more hydraulic pumps will supply hydraulic fluid under pressure to the various electrohydraulic control valves, the operation of which valves are typically controlled electrically through the use of an electronic controller or other processing device which outputs appropriate signals to the valve actuating devices of the control valves to control the flow of fluid to an actuating cylinder, a motor, or other actuating device coupled to a particular work element or implement. It is recognized that the pressure of the fluid to the actuating cylinder, motor, or other actuating device could be controlled independent of the flow without departing from the essence of the invention. As illustrated in FIGS. 1 & 2, a controller 58 receives operator input signals from one or more operator input mechanisms 40 used to control the operation of a particular implement or work element. Examples of an operator input mechanism include an electronic joystick, control lever, foot actuated pedal, or other operator input device. The controller 58 will deliver valve command signals, indicative of the desired operation of the associated implement, to the appropriate valve in response to the received operator input signal. In this manner the valve may be controlled to provide an appropriate amount of fluid flow to the implement actuator device 20 to control the operation of the implement 14 as desired by the operator. While the present invention will be described with respect to the type of work machine shown in FIG. 1 and, in particular, with respect to implement 14 as the work element, it can be appreciated by one skilled in the art that the present invention can be used in connection with any type of work machine having any type of work elements controlled through the use of one or more electrohydraulic valves.

Referring now to FIG. 2, one embodiment of an electro hydraulic control system 30 using a pressure compensator 32 for compensating fluctuations in fluid pressure drop across valve 42 and thus controlling flow of the hydraulic fluid supplied by the pump 28 to actuator device 20 is illustrated. In general, control system 30 represents software that determines and supplies an input flow control signal to a valve 42 in communication with the pump 28 and coupled to actuator device 20 such that a desired velocity, Vi, of actuator device 20 is achieved. The control system 30 is preferably located on a controller 58. Specifically, valve 42 is any type of metering valve and defines a variable opening (not shown) which controls the amount of hydraulic fluid allowed to flow through the valve based on the input flow control signal received from the control system 30. The desired velocity, Vi, of actuator device 20 is determined based upon an operator input signal. The operator input signal may be generated by an operator of work machine 10 upon activation of an operator input control mechanism 40. Control system 30 includes a comparator 36, such as a summing junction, which compares the desired velocity, Vi, with the actual velocity, Vof, of actuator device 20. A sensing device 38 may be used to sense a characteristic indicative of actuator device velocity, and responsively generate a velocity indicative signal. The sensing device 38 may be a position sensor or other type of device capable of sensing a parameter indicative of actuator device velocity. Comparator 36 generates a comparator output signal representing the difference between the desired velocity, Vi, and the actual velocity Vof as indicated by the velocity indicative signal. The comparator output signal may then inputted to command generator 34. Command generator 34 may be used as a signal amplifier or a buffer to provide a discrete comparator output signal to be inputted into modification device 50.

Figure 3:
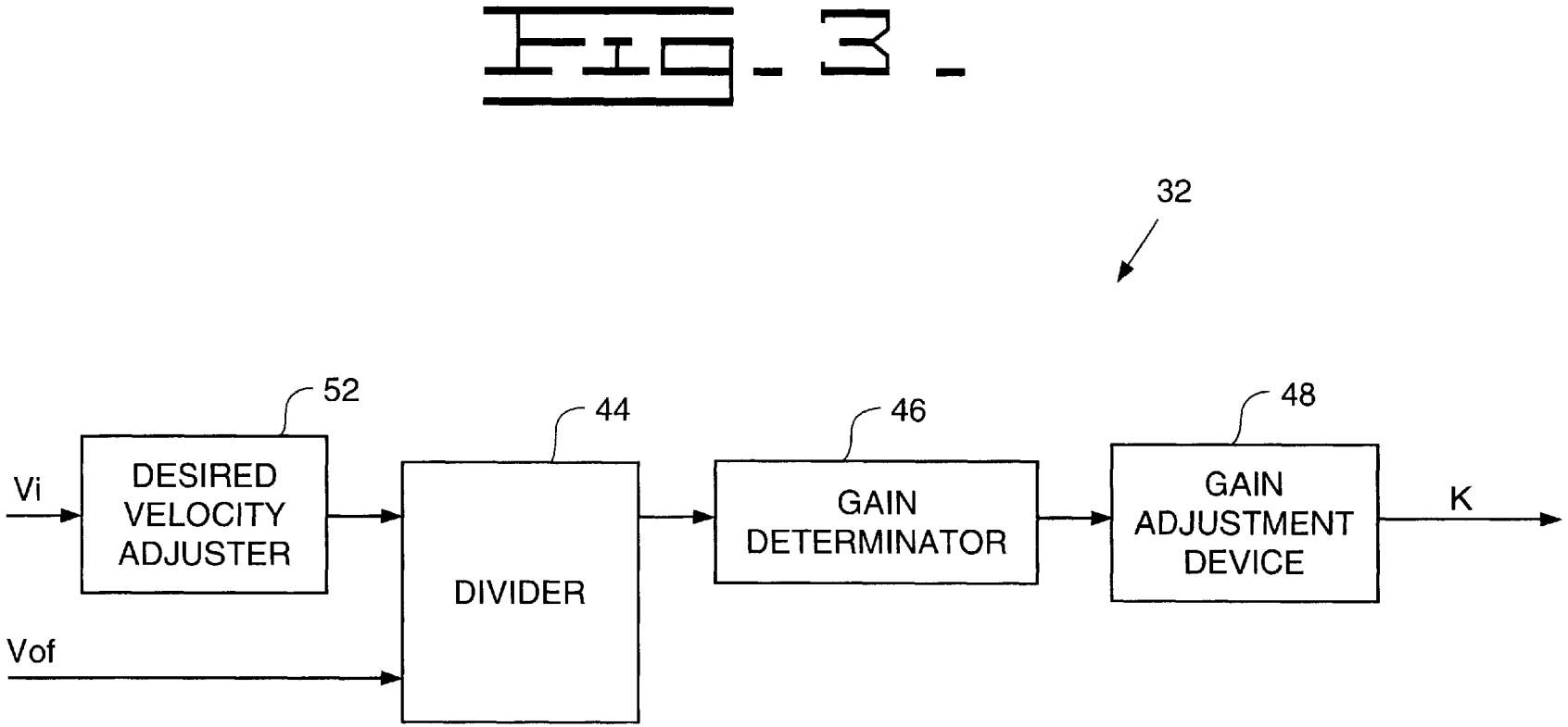
FIG. 3 is a block diagram of the pressure compensator shown in FIG. 2.

With further reference to FIG. 3, in one embodiment, pressure compensator 32 may include a divider 44 for receiving the operator input signal indicative of the desired velocity, Vi, of actuator device 20 and the output of the sensing device 38 indicative of the actual velocity, Vof, of actuator device 20 and calculating the ratio therebetween to generate a divider output signal indicative of such ratio. Pressure compensator 32 may include a desired velocity adjuster 52 for adjusting the desired velocity, Vi, represented by the operator input signal to insure that a desired velocity of zero is not input into divider 44, which may lead to erroneous determinations. In one embodiment, the bigger value of a velocity of 0.01 times the maximum actuator device velocity, or some other predetermined percentage or other factor and the desired velocity, Vi, is used as output of adjuster 52 so as to have a negligible effect on the overall performance of pressure compensator 32, while ensuring the desired velocity signal is a non zero value.

Pressure compensator 32 may also include a gain determinator 46 in the form of memory for storing a table or graph which defines a target gain for the desired velocity, Vi, and actual velocity, Vof, represented in the ratio calculated by divider 44. If the actual velocity, Vof, is equal to the desired velocity, Vi, the gain determined by gain determinator 46 will be one, representing no change of pressure drop from the designed value across valve 42. Under such conditions, no pressure compensation is necessary. If the actual velocity, Vof, is greater or less than the desired velocity, Vi, the gain determined by gain determinator 46 will be less or greater than one, respectively, representing a change across valve 42. The gain may be a fixed value, or a dynamically determined value. Under these conditions, pressure compensation is necessary to account for the differences between the desired velocity, Vi, and the actual velocity, Vof, of actuator device 20.

The target gain determined by gain determinator 46 may be inputted to a gain adjustment device 48 for adjusting the target gain determined by gain determinator 46 to account for non-linearities in control system 30 and/or increase stability margin. In one embodiment, gain adjustment device 48 is a first order transfer function. Gain adjustment device 48 generates a pressure compensator coefficient, K, representative of the target gain determined by gain determinator 46 and adjusted by gain adjustment device 48.

Referring back to FIG. 2, the pressure compensator 32 serves as part of a forward loop gain of control system 30 to compensate for the change of pressure drop across valve 42. Specifically, control system 30 includes a modification mechanism 50 for receiving the controller output signal generated by command generator 34 and the pressure compensator coefficient K calculated by pressure compensator 32. In one embodiment, the modification mechanism 50 is a multiplier. The command generator 34 output signal is multiplied by the pressure compensator coefficient, K , to produce the input flow control signal, or valve command signal, to be inputted to valve 42 so that the desired velocity, Vi, can be achieved by actuator device 20. Specifically, the pressure compensator coefficient K adjusts the command generator 34 output signal to compensate for any changes of pressure drop across valve 42, which are determined by pressure compensator 32. The opening of valve 42 changes based on the value of the input flow control signal it receives. While pressure compensator 32 is shown in connection with a closed loop control system 30, it can be appreciated by one skilled in the art that it can be used in connection with both open and closed loop control systems.

Figure 4:
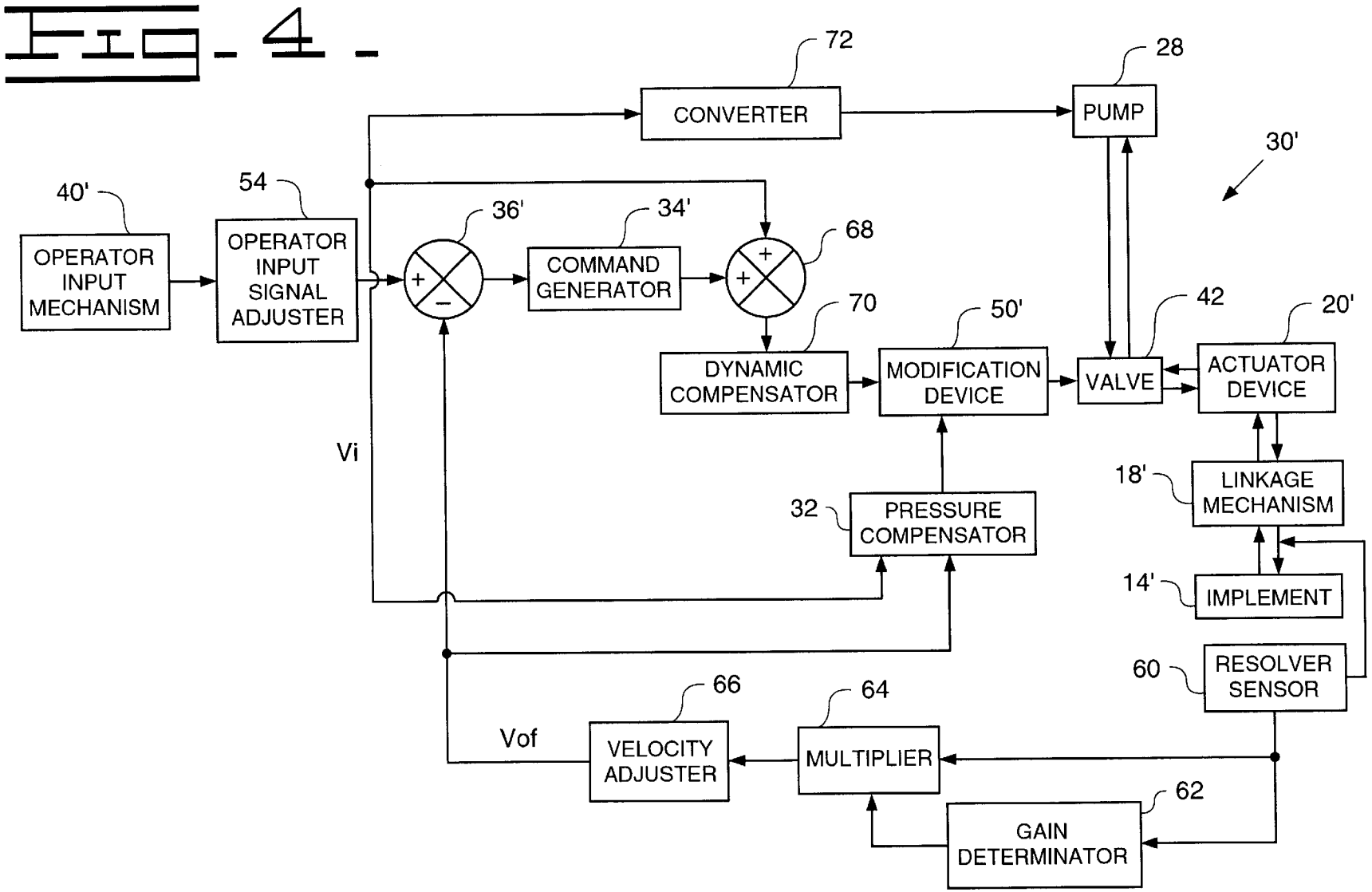
FIG. 4 is a block diagram of another embodiment of an electro hydraulic control system with pressure compensation according to the present invention.

FIG. 4 represents another embodiment of an electro hydraulic control system using the pressure compensator of FIG. 3. The desired velocity, Vi, of actuator device 20' is determined based on an operator input signal generated by an operator of work machine 10 upon activation of an operator input control mechanism 40'. Control system 30' may include an operator input signal adjuster 54 to adjust the velocity represented by the operator input signal to create a smoother input velocity signal. For example, in the embodiment of FIG. 4, the smoothing function of the operator input signal adjuster may be used to account for non-linearities of operator input control mechanism 40'. In the embodiment of FIG. 4, operator input signal adjuster 54 is a first order transfer function and, the output of the operator input signal adjuster 54 is indicative of a desired velocity Vi. A comparator 36', such as a summing junction, compares the desired velocity, Vi, with the actual velocity, Vof, of actuator device 20'.

The actual velocity, Vof, of actuator device 20' may be determined through the use of a sensing device, such as a resolver sensor 60 coupled to a linkage mechanism 18' associated with the work machine which, in turn, is coupled to actuator device 20' and implement 14'. Instead of using a direct actuator device sensor 38 as set forth in FIG. 2 for directly determining the actual velocity, Vof, of actuator device 20', resolver sensor 60 determines the position and velocity of linkage mechanism 18', the actual velocity, Vof, of actuator device 20' associated with linkage member 18', being a function of the linkage velocity and position of linkage member 18'. As a result, the actual velocity of actuator device 20' may be determined based on the overall position and velocity of linkage member 18'.

Referring back to FIG. 4, linkage member 18' receives a load signal representing the load being applied to implement 14'. The resolver sensor 60 is placed in communication with the output of linkage member 18' and senses the velocity and position of linkage member 18'. A signal representing the position of linkage member 18', measured by resolver sensor 60, is then inputted to a gain determinator 62 from which a gain is determined representing a ratio between the velocity of actuator device 20' and the linkage member velocity sensed by resolver sensor 60. In the embodiment of FIG. 4, gain determinator 62 represents memory for storing a table or graph, which includes the ratio of actuator device velocity with respect to linkage member velocity.

A multiplier 64 is placed in communication with resolver sensor 60 for receiving a signal representing the velocity of linkage member 18' and a signal representing the gain determined by gain determinator 62. Multiplier 64 multiplies the linkage velocity by the gain so as to produce a signal representing the actual velocity, Vof, of actuator device 20'. Control system 30' may also include an actuator device velocity adjuster 66 for filtering out any noise in the output signal generated by resolver sensor 60. In the embodiment of FIG. 4, actuator device velocity adjuster 66 is a second order transfer function.

With further reference to FIG. 4, command generator 34' receives the comparator output signal which is then inputted to summer 68. The output signal of the operator input signal adjuster 54, representing the desired velocity of actuator device 20', is also inputted to summer 68 in a feed forward loop manner. The output signal of summer 68 may then be inputted to a dynamic compensator 70, to compensate for the dynamics of valve 42', and thus improve the performance and stability of work machine 10. In the embodiment of FIG. 4, dynamic compensator 70 represents a ratio between second order transfer functions. The output signal of dynamic compensator 70 is then inputted to modification mechanism 50' and multiplied by the pressure compensator coefficient K, determined by pressure compensator 32' to produce the input flow control signal to be inputted to valve 42'. An appropriate hydraulic pump 28 is utilized to provide hydraulic fluid flow under pressure to actuator device 20' via valve 42'. Depending on the value of the input flow control signal, the opening of valve 42' is adjusted to control the amount of hydraulic fluid permitted to flow from pump 28 to actuator device 20' such that the desired velocity, Vi, of actuator device 20' is achieved. In the embodiment of FIG. 4, control system 30' also may include a converter 72 for converting the adjusted desired velocity to a flow rate for inputting to pump 28.

INDUSTRIAL APPLICABILITY

As described herein, the pressure compensator of the present invention allows better actuator device velocity control and thus better accuracy of control systems 30,30'. Since the pressure drop across valve 42,42' cannot be kept constant due to the fact that a single hydraulic power supply is used to operate multiple cylinders throughout work machine 10, a system and method for taking into account such pressure changes is desired. Pressure compensator 32, 32' compensates for such pressure changes by calculating a pressure compensator coefficient K which is used to modify the signal being inputted to the valve 42,42' so that the flow of hydraulic fluid therethrough produces a desired velocity in actuator device 20,20'.

The present pressure compensator has particular utility in any type of hydraulic system which utilizes an electro hydraulic control valve for controlling the flow of hydraulic fluid through any type of actuator devices. A user of the present invention may choose either of the control system configurations discussed herein or an equivalent thereof, depending upon the desired application. In this regard, it is recognized that various forms of the subject pressure compensator could be utilized without departing from the essence of the present invention. As is evident from the foregoing description, certain aspects of the present invention are not limited by the particular details of the examples illustrated herein, and it is therefore contemplated that other modifications and applications will occur to those skilled in the art. It is accordingly intended that the claims shall cover all such modifications and applications that do not depart from the sprit and scope of the present invention.

Other aspects, objects and advantages of the present invention can be obtained from a study of the drawings, the disclosure and the appended claims.

What is claimed is:

1. A pressure compensator for use in a control system for an electro hydraulic-implemented work element being operated through the use of operator input control mechanisms generating operator input signals upon the application thereof, the work element including an actuator device coupled thereto for controlling the operation thereof, the control system comprising:

a sensing device in communication with the actuator device and adapted to determine an actual velocity of the actuator device, the sensing device outputting an actual velocity signal indicative of the actual velocity determined by the sensing device;

a valve in communication with the actuator device and defining an opening therein for allowing a hydraulic fluid to flow therethrough;

a comparator in communication with the sensing device and an operator input control mechanism configured to generate an operator input signal indicative of a desired velocity of the actuator device, the comparator being adapted to receive the actual velocity signal and the operator input signal and to produce a comparator output signal having a comparator output value representing the difference between the desired velocity and the actual velocity of the actuator device;

a pressure compensator adapted to receive the operator input signal and the actual velocity signal, and to generate a pressure compensator coefficient representing a ratio therebetween, the ratio being indicative of a change in pressure across the valve; and modification device in communication with the comparator, the pressure compensator and the valve for modifying the comparator output signal by the pressure compensator coefficient to generate an input flow control signal for input to the valve, the input flow control signal being adapted to control the variable opening of the valve in order to compensate for the pressure change across the valve determined by the pressure compensator so that the desired velocity of the actuator devices is achieved.

2. The system of claim 1, wherein the pressure compensator comprises:

a divider in communication with the operator input signal and the actual velocity signal, the divider having a divider output signal and being configured to divide the actual velocity by the desired velocity; and pressure compensator coefficient determination devices in communication with the divider for determining the pressure compensator coefficient necessary to compensate for the change of pressure drop across the valve based on the divider output signal.

3. The control system of claim 2, wherein the pressure compensator coefficient determination devices comprises memory for storing a graph representing a relationship between the desired velocity and the actual velocity of the actuator device.

4. The control system of claim 1 wherein the comparator is a summing junction.

5. The control system of claim 1 wherein the actuator device is one of a hydraulic cylinder and a motor.

6. The control system of claim 1 wherein the pressure compensator is implemented via software.

7. The control system of claim 1 wherein the valve is a metering valve.

8. The control system of claim 1 wherein the sensing device is a sensor.

9. The control system of claim 1 wherein the modification devices includes a multiplier.

10. The control system of claim 1 wherein the work element includes a link mechanism coupled to an actuator device, and wherein the sensing device includes:

a sensor coupled to the linkage mechanism and adapted to determine a position and a velocity of the linkage mechanism;

a gain determinator in communication with the sensor and adapted to determine a gain based on the linkage position sensed by the sensor; and a multiplier placed in communication with the sensor and the gain determinator, the multiplier being adapted to multiply the linkage velocity sensed by the sensor with the gain determined by the gain determinator, and to produce the actual velocity signal indicative of the actual velocity of the actuator devices.

11. The control system of claim 10 wherein the sensor is a resolver sensor.

12. A method for compensating for pressure fluctuations in an electro hydraulic implemented-work element being operated through the use of operator input control mechanism generating operator input signals upon the application thereof, the work element including actuator devices coupled thereto for controlling the operation thereof, the method comprising:

determining a desired velocity of the actuator device;

determining an actual velocity of the actuator devices;

comparing the desired velocity and the actual velocity; generating a comparator output signal indicative of the comparison between the desired velocity and the actual velocity;

calculating a pressure compensator coefficient representing a ratio between the actual velocity and the desired velocity, the ratio being indicative of a change in pressure across the valve;

modifying the comparator output signal by the pressure compensator coefficient to produce an input flow control signal; and inputting the input flow control signal to the valve, the input flow control signal being configured to control the variable opening of the valve in order to compensate for the pressure change so that the desired velocity of the actuator devices can be achieved.

13. The method of claim 12, wherein the method is implemented via software.

14. The method of claim 12, wherein the valve is a metering valve.

15. The method of claim 12, wherein the actuator devices is one of a hydraulic cylinder and a motor.

16. The method of claim 12, wherein the step of determining the actual velocity of the actuator devices includes sensing a position and a velocity of the actuator devices.

17. The method of claim 12, wherein the step of calculating a pressure compensator coefficient comprises:

dividing the actual velocity by the desired velocity to produce a ratio; and determining a gain which is representative of the ratio between the actual velocity and the desired velocity.

18. The method of claim 12, wherein the step of comparing is performed via a summing junction.

* * * * *

UNITED STATES PATENT AND TRADEMARK OFFICE

CERTIFICATE OF CORRECTION

PATENT NO. : 6,609,369 B2
DATED : August 26, 2003
INVENTOR(S) : Douglas W. Koehler et al.

It is certified that error appears in the above-identified patent and that said Letters Patent is hereby corrected as shown below:

Column 6,
Line 65, delete "pressure compensator for use in a"

Signed and Sealed this

Twenty-third Day of December, 2003

JAMES E. ROGAN
*Director of the United States Patent and Trademark Office*